US005679919A

United States Patent [19]

Holm et al.

[11] Patent Number: 5,679,919

[45] Date of Patent: Oct. 21, 1997

[54] METHOD AND APPARATUS FOR IMPARTING TO AN AIRBORNE WARHEAD A DESIRED PATTERN OF MOVEMENT

[75] Inventors: Anders Holm, Karlskoga; Jan Axinger, Storfors; Kenneth Jarnryd, Hägersten, all of Sweden

[73] Assignee: Bofors AB, Karlskoga, Sweden

[21] Appl. No.: 525,734

[22] PCT Filed: Mar. 17, 1994

[86] PCT No.: PCT/SE94/00232

§ 371 Date: Dec. 5, 1995

§ 102(e) Date: Dec. 5, 1995

[87] PCT Pub. No.: WO94/23265

PCT Pub. Date: Oct. 13, 1994

[30] Foreign Application Priority Data

Mar. 30, 1993 [SE] Sweden ..... 9301038

[51] Int. Cl.[6] ..... F42B 12/58

[52] U.S. Cl. ..... 102/377; 102/378; 102/489; 244/3.22

[58] Field of Search ..... 102/372, 373, 102/377, 378, 489, 342, 351, 357, 393; 244/3.22, 3.23

[56] References Cited

U.S. PATENT DOCUMENTS

| | | | |
|---|---|---|---|
| 3,457,861 | 7/1969 | Crockett | 102/384 |
| 3,724,782 | 4/1973 | Makow | 244/3.23 |
| 3,771,445 | 11/1973 | Campbell et al. | 104/129 |
| 4,531,693 | 7/1985 | Raynaud et al. | 244/52 |
| 4,625,646 | 12/1986 | Pinson | 102/489 |
| 4,690,062 | 9/1987 | Bugiel | 102/476 |
| 4,745,861 | 5/1988 | Fenton et al. | 102/377 |
| 4,858,532 | 8/1989 | Persson et al. | 102/384 |
| 5,088,414 | 2/1992 | Vesa | 102/388 |
| 5,155,294 | 10/1992 | Vesa | 102/388 |
| 5,158,246 | 10/1992 | Anderson, Jr. | 244/3.22 |
| 5,210,372 | 5/1993 | Tripptrap et al. | 102/489 |
| 5,277,116 | 1/1994 | Axinger et al. | 102/388 |
| 5,280,752 | 1/1994 | Borgstrom et al. | 102/384 |
| 5,282,422 | 2/1994 | Borgstrom et al. | 102/384 |
| 5,315,933 | 5/1994 | Paulsson et al. | 102/489 |
| 5,317,975 | 6/1994 | Sauvestre et al. | 102/489 |
| 5,341,743 | 8/1994 | Redaud | 102/384 |
| 5,398,615 | 3/1995 | Johnsson et al. | 102/489 |

FOREIGN PATENT DOCUMENTS

| | | | |
|---|---|---|---|
| 385878 | 9/1990 | European Pat. Off. | 244/3.22 |
| 1165802 | 10/1969 | United Kingdom . | |
| 2265342 | 9/1993 | United Kingdom | 244/3.22 |
| 94/23266 | 10/1994 | WIPO | 102/489 |

*Primary Examiner*—Michael J. Carone
*Assistant Examiner*—Christopher K. Montgomery
*Attorney, Agent, or Firm*—Pollock, Vande Sande & Priddy

[57] ABSTRACT

A method and apparatus is for imparting, in a continuous sequence, a predetermined rotational movement to a warhead releasably housed in a protective canister and ejected out in ballistic ejection trajectories from the canister. The canister is spun to the desired rotational speed by flow of combustion gases through gas outlet nozzles discharging in the outer periphery of the canister and supplied from a central combustion chamber in which a propellant powder charge is combusted. The combustion gases are then led from the combustion chamber, in the final phase of the propellant charge combustion, through gas outlets facing towards the warhead and initially covered by the propellant charge and exposed as a result of the combustion, for ejecting the warhead out of the canister.

7 Claims, 5 Drawing Sheets

12
2
31
32
34
35
8
3
9
10
3

METHOD AND APPARATUS FOR IMPARTING TO AN AIRBORNE WARHEAD A DESIRED PATTERN OF MOVEMENT

BACKGROUND OF THE INVENTION

The present invention relates to a method and an apparatus for transferring warheads provided with their own target seekers and first discharged into ballistic trajectories in a non-rotary state, in which the warhead and target seeker are inactivated to a second, fully developed rotary state. During the second downward state of their trajectory the warhead is spun about its major axis of inertia to a predetermined speed, given a fall velocity which is predetermined during such search and effect phase determined by specific aerodynamic brake surfaces which are activated. In its stable fall trajectory, with the center of the warhead and main axes of inertia directed in a predetermined manner in relation to the fall trajectory at the same time as the target seeker is activated to seek an adjacent target area, and the effective charge of the warhead is made ready, in the event of identification of a target by the target seeker, to be discharged in the correct search direction to attack the target.

The warhead referred to here is, therefore given a complex trajectory in which the problem resides in imparting to the warhead, within the shortest possible launch trajectory, a sufficiently long fall trajectory for its seek-and-effect phase concurrently with the non-rotary state of the warhead, before its active seek-and-effect phase has been commenced, must have been transferred to a rotary state and given a stable fall trajectory for which a plurality of specific requirements must be established in respect to the direction and rotation of the warhead.

In warheads of similar type, it is previously known to releasably house them in a protected canister up to that point in time when their target seeker and aerodynamic brake surfaces are to be activated and then, with the aid of a pyrotechnic charge, eject the warhead out of the canister, whereupon target seeker and brake surfaces are flipped out by spring force and/or under the action of the inertia forces and aerodynamic forces acting on the warhead.

The problem which has been solved by means of the present invention is, in a continuous and unbroken sequence, to impart to the warhead its above-mentioned rotation and, in connection therewith, to eject it out of its protective canister.

As its search-and-effect phase is initiated, the warhead functions in basically the same manner as corresponding warheads of previously known type which are directed to a relevant target area by a rotation-stabilized projectile such as an artillery shell or the like and from which the complete warhead is separated when the projectile reaches the immediate proximity of the target area in order thereafter to be retarded to the desired values of rotation and fall velocity, and is given the same type of stable fall trajectory and general direction as the warhead according to the present invention. In those cases where the complete warhead is transported to its target area by a rotary projectile, the entire system will, however, be somewhat simpler since it is then primarily a matter of retarding the rotation and fall velocity of the warhead released from the vehicle (the shell) to desired levels, and of controlling the rotation of the warhead so that this takes place about its major axis of inertia which must make a predetermined angle with the angle of effect of the warhead.

The vehicle (hereinafter designated as a capsule) which is referred to in this context may, for example, consist of a cruise missile with its own target seeker and carrying large number of complete warheads which it may eject when its own target seeker has identified the target, or, alternatively, the capsule may consist of a pair of a permanent booby-trap mining or the like.

As already mentioned warheads of the type under consideration here will, as soon as they have reached the seek-and-effect phase, function in exactly the same manner irrespective of whether they were transported to the target area by a rotary vehicle such as an artillery shell or by a capsule of another type from which they are initially ejected under non-rotary conditions. On the other hand, ejection from a non-rotary vehicle (which moreover generally moves closes to ground level) imposes other specific requirements on the functional stages prior to the search-and-effect phase. This also places demands on a number of components which are unnecessary in the alternative employment of an artillery shell as the vehicle. The actual warhead subcomponents fixedly included therein such as a target seeker, effect charge and aerodynamic brake surfaces regulating the fall trajectory of the warhead may, however, be identical. Warheads of this general type are described in the European patents and European applications listed below: 0 252 036; 0 424 337; 0 451 123; 92 850 218,6; 92 850 217,8; 92 850 202,0; 92 850 238,4. The general function of the warheads under consideration here are, in this instance, described in the first of these patents (0 252 036), while the remaining patents primarily relate to different partial solutions which are not all necessarily included in warheads pertinent to the present invention.

In general terms, the mechanical stresses on the warheads will be greater if they are transported to the target area by an artillery shell than if they are conveyed to the target area by an aerodynamic capsule and only ejected from the capsule when in the immediate proximity of the target area.

If the warhead is included in a capsule which follows an aerodynamic, non-rotary trajectory relatively close to ground level, as is fixedly placed therein, the warhead must, first be given sufficient flight altitude in the form of a ballistic launch trajectory by, for example, a pyrotechnically activated launching from the capsule. This occurs at a time and in a direction predetermined beforehand in relation to the contemplated target area, and, in connection with or in immediate association with the ejection is, in addition to the initially necessary flight altitude, also given the desired rotation and a stable fall trajectory of a predetermined fall velocity during which the target seeker and warhead must be activated. In addition, the warhead must be rotated about a major axis of inertia which makes a predetermined angle with the main axes of the target seeker and the warhead, to realize the helical scanning or target seeking of the target area as described in EP 0 252 036.

The general scenario fox the employment of a weapon of the above-described type may be as follows:

From a long distance, the capsule is launched in a direction towards where the target is assumed to be. When the capsule's own target seeker has identified the target, the predetermined number of complete warheads is ejected out of the capsule. This is put into effect preferably rearwardly at an angle determined in view of the flight speed of the capsule. By adaptation of the ejection velocities of the complete warheads in relation to the velocity of the capsule itself and the selected angle of ejection, the warhead may be put into a desired ballistic trajectory which takes it to a predetermined point above the identified target. If the ejection out of the capsule is effected using a rocket launcher, this should, as soon as it is no longer needed, be discarded from the second main stage of the warhead, hereinafter referred to as the cylinder.

Until the second main stage, the cylinder, of the warhead, has reached the zenith of its new ballistic trajectory, it may be necessary to retard its pendulum movements. This may be effected by means of a parachute which, after the cylinder has passed its own trajectory zenith, will assume the more regular function of a parachute.

Once the cylinder has passed the zenith of the ballistic trajectory and been retarded to a substantially vertical fall trajectory, it is important to impart to the actual warhead a carefully predetermined rotation and to activate its target seeks and those brake surfaces which are to control its continued fall trajectory. All of this must be carried out so that the warhead will have a stable fall trajectory rotating about a major axis of inertia which, as closely as possible, coincides with the trajectory tangent while the effected direction of the warhead and the scanning direction of the target seeker make an angle with the trajectory tangent.

SUMMARY OF THE INVENTION

The present invention primarily relates to this final stage in which the warhead is given the desired rotation and its target seeker and ultimate brake surfaces are activated.

The target seeker and the brake surfaces are activated by being flipped out, at the same time that as the warhead is given the desired rotation and is released from the previously mentioned canister with its parachute. These flip-out brake surfaces may be of the type described in EP 908 503 25.3 and their design is of major importance so as to impart to the warhead a pendulum-free fall trajectory towards ground level.

The target seeker may also be of the type which is disclosed in EP 908 503 25.3.

The warhead relevant in the present context is, thus, initially (i.e. from the starting position in the capsule) enclosed in a canister which is separably joined with a rocket motor to eject it from the capsule. The canister is in the form of a cylinder open at one end and in which the actual warhead is ejectably housed. The devices characteristic of the present invention are housed in the closed end of the canister. A canister which merely has a protective function, and without any of the devices particularly distinctive of the present invention, is described in EP 928 502 38.4.

The socket motor activated on command from the target seeker of the capsule thus ejects out the cylinder, i.e. the canister plus warhead, which, after separation from the rocket motor will enter into the previously described ballistic launch trajectory. In connection with the separation from the rocket motor, the parachute necessary for such factors as retardation of any possible pendulum movements, will be opened as mentioned previously. When the rocket starts, a time function which determines subsequent functional sequences is also started.

When the cylinder has reached the zenith of its ballistic trajectory, the parachute is transformed from previously having been more of a pendulum brake to serving a more purely defined parachute function. At a time in the downwardly directed section of the fall trajectory determined by the time function, a combined function designed in accordance with the present invention is activated for imparting to the warhead the rotation necessary for the continued trajectory and ejection of the warhead out of the canister.

According to the present invention, this effect is achieved by equipping the canister with an annular combustion chamber which is disposed concentrically about the main axis of the canister and is provided with one or more gas outlet nozzles whose outlet direction makes an angle with the radius of the combustion chamber passing therethrough, i.e. they are more or less tangential. In the combustion chamber there is further disposed a similarly annular propellant charge which, with its one broad side, covers one or more gas outlets discharging in a direction towards the warhead, while its other broad side is free to be ignited by a pyrocharge disposed in the center of the canister and initiated by the time function. Between the warhead and the gas outlets disposed in a direction towards the warhead, there is preferably disposed a displaceable sabot which, when actuated by the gas pressure from the combustion chamber, forces the warhead out of the canister.

The operational cycle will thus be that the cylinder first spins up in speed by means of the combustion gases flowing out through the more or less tangentially disposed gas outlet nozzles, while the warhead is only then acted on when the gas outlets directed towards the warhead have been opened in that the propellant is more or less burned out, via the displaceable sabot and is forced out of the canister, whereupon the target seeker and the warhead's own aerodynamic brake surfaces (which have been held in the collapsed position by the canister wall, are flipped out and the target seeker is activated).

The present invention has been defined in the subsequent claims and will now be further described in its context together with the accompanying drawings.

DETAILED DESCRIPTION OF THE PREFERRED EMBODIMENT(S)

Figure 1:
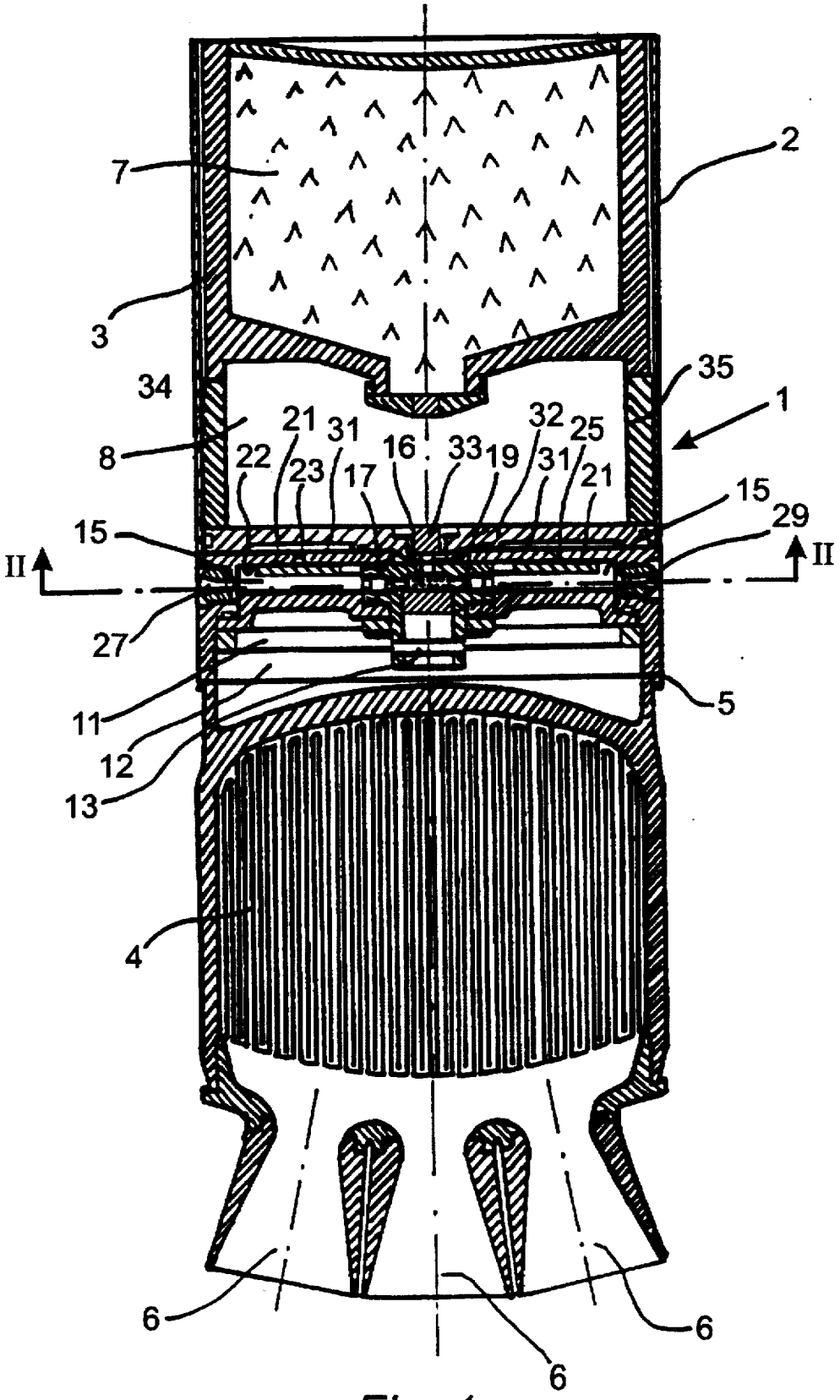
FIG. 1 is a longitudinal section through a complete warhead.

The complete warhead 1 illustrated in FIG. 1 includes the so-called cylinder, consisting of a canister 2 and a warhead 3 mounted therein against its effective charge 7 and various accessories such as target seeker etc. and a rocket motor 4. In the illustrated embodiment, the cylinder and rocket motor are held together by a releasable joint 5 in the form of a simple lap joint between them. This is, fully satisfactory since the combination will either be located in the launching position in a barrel or tube adapted thereto which keeps together the various parts; or alternatively, the acceleration forces will hold the parts together during launching until the rocket motor stops and it is then that the parts are separated from one another, which is a direct consequence of the effect of the aerodynamic forces on the combination.

The rocket motor 4 is a powder rocket motor with, for example, seven outlet nozzles 6, three of which are visible in the drawings to impart a sufficiently rapid impulse. The barrel or tube in which the rocket motor—cylinder of the combination is to be mounted must be made very short for reasons of necessity.

The cylinder thus includes the canister 2 and the warhead 3. The effective charge 7 included in the warhead may, for example, be a projectile-forming directed effect charge. The target seeker is designated with reference numeral 8. These details have, like the brake surfaces 9 and 10, not shown in FIG. 1, since they are completely collapsed in place. The appearance of the details 8–10 is most clearly apparent from FIGS. 5 and 6 where they are shown in their flipped-out position.

Figure 2:
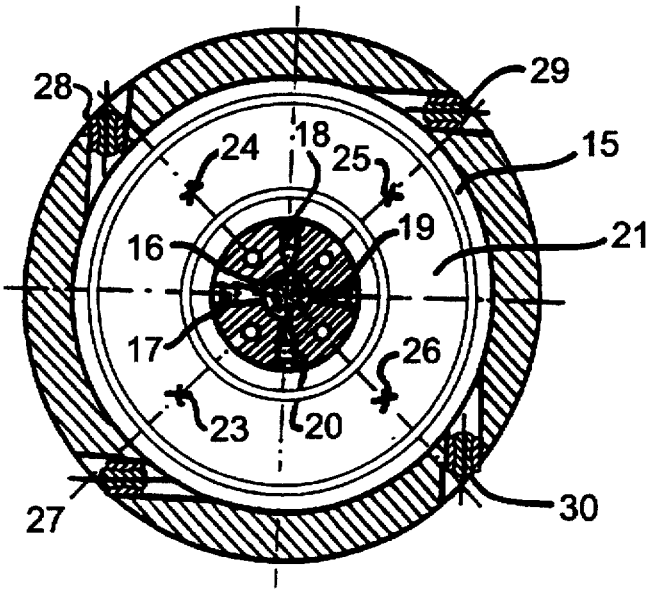
FIG. 2 is a cross section along the line II—II in FIG. 1.

Between the upper wall of the rocket motor 4 and the canister 2, there is a space 11 in which a parachute 12 is packed. This is secured in the canister as a fitting 13. In the end of the canister facing towards the rocket motor there is further disposed an annular combustion chamber 15 whose appearance is also apparent from FIG. 2. This is associated with a centrally located ignition charge 16 which, via four non-return valves 17–20, is in communication with the combustion chamber 15 in which an annular propellant charge 21 is disposed. With its one broad side, the propellant charge is glued against the end wall 22 of the combustion chamber 15 and turned to face the warhead 3, thereby covering a number (in the present case four) of gas outlets 23–26 directed towards the warhead 3. The ocher broad side of the propellant charge 21 is open for ignition. The combustion chamber 15 is further provided with four substantially tangential gas outlet nozzles 27–30 (see also FIG. 2).

The gas outlets 23–26 discharge in an annular chamber 31 behind a displaceable sabot 32 which, when shifted, will jerk the warhead 3 out of the canister 2. There is disposed in the center of the warhead 3 an electric igniter 33 which transmits an ignition impulse from a time function integrated in the target seeker 8 to the pyrocharge 16. Between the sabot 32 and the warhead, two support halves 34 and 35 are disposed (see FIG. 5).

Figure 3:
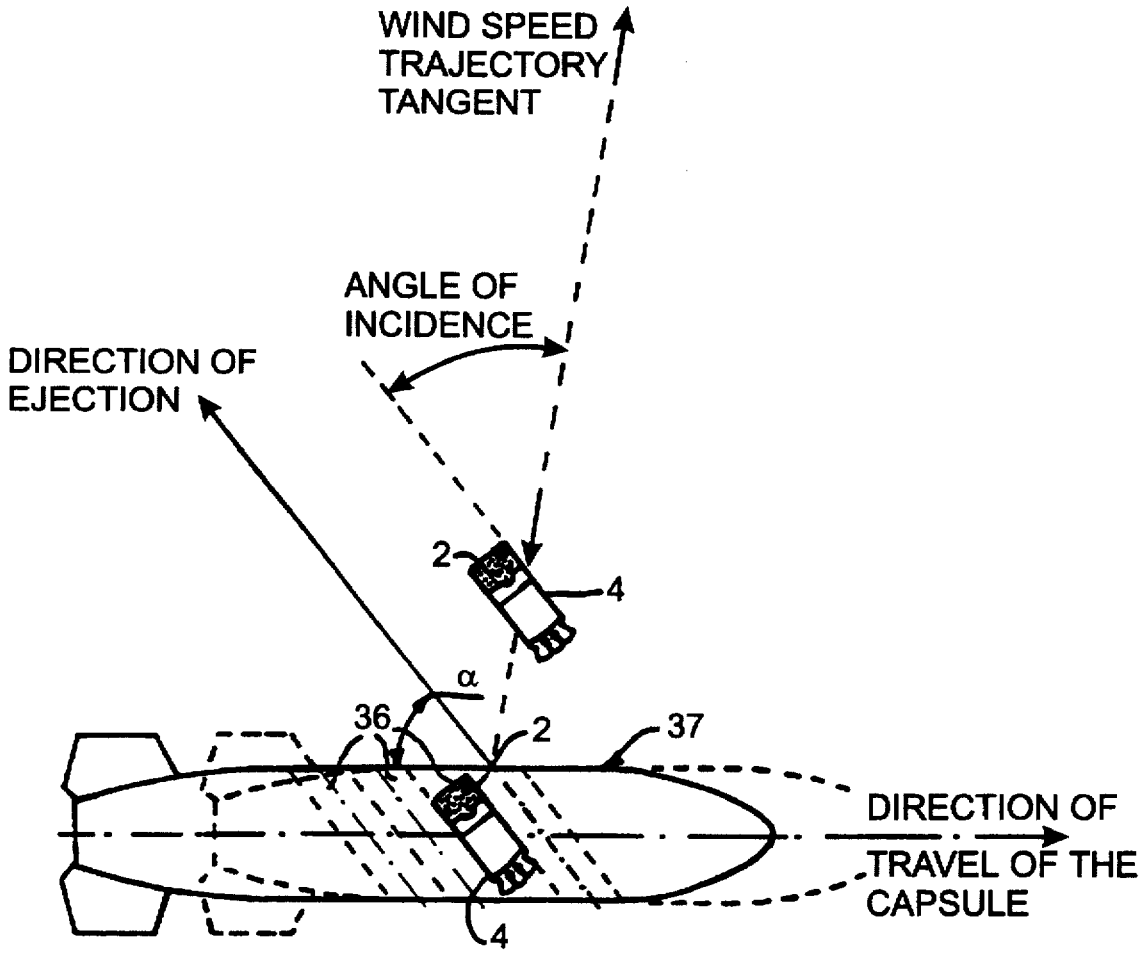
FIG. 3 is a basic sketch showing ejection of a complete warhead out of a capsule.

The substantially complete warhead 1 described in FIG. 1 is, as shown in apparent FIG. 3, intended to be mounted, together with a number of identical warheads, each in their barrel or tube 36 in a capsule 37. As is also apparent from FIG. 3, the ejection is affected in an angle $\alpha$ rearwardly of the direction of travel of the capsule 37. This will impart to the warhead a ballistic ejection trajectory in the direction of the sketched trajectory tangent. The ejection preferably takes place on command from a target seeker integrated in the capsule when this has identified combat-worthy targets M. (See FIG. 4.)

Figure 4:
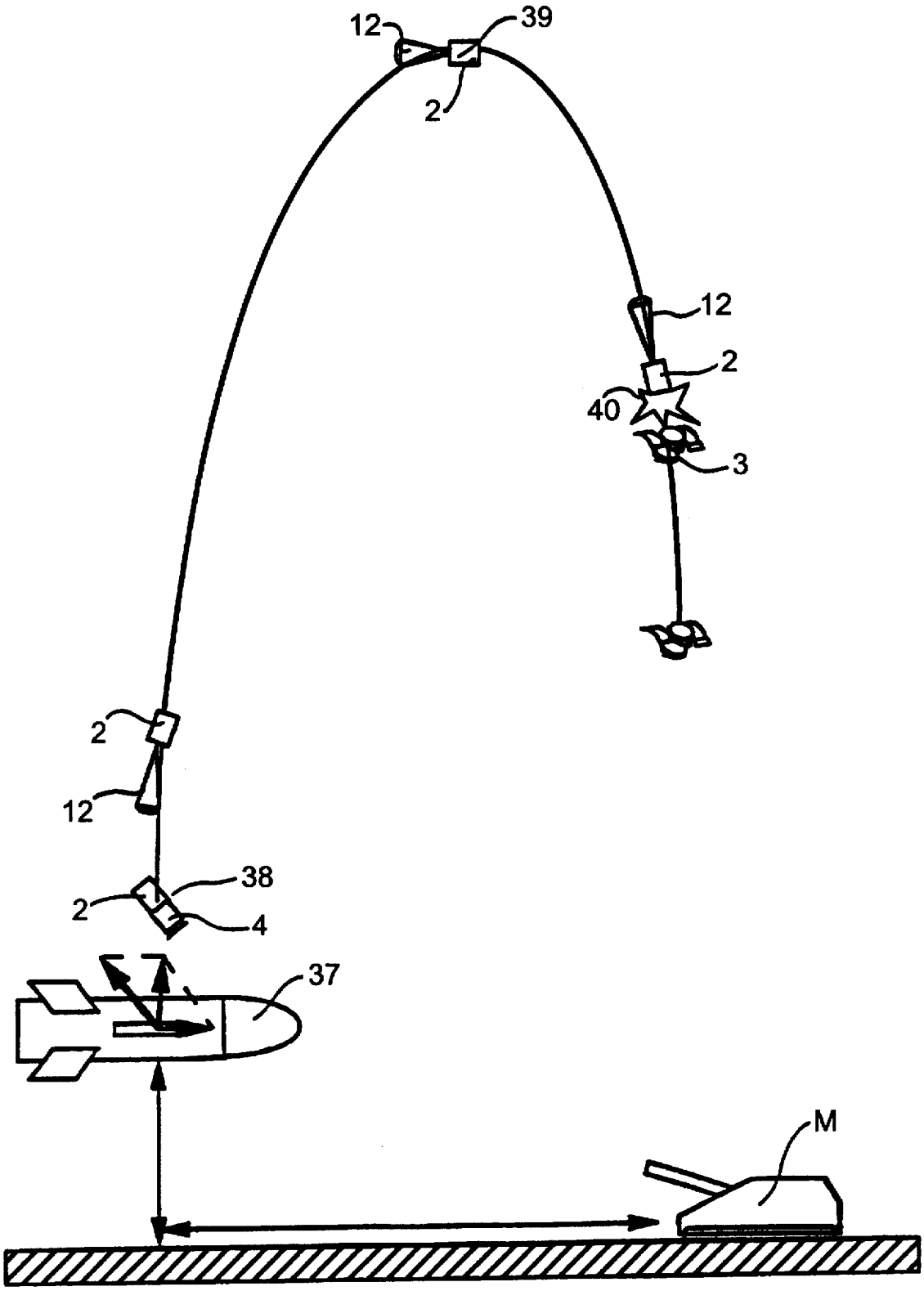
FIG. 4 shows the complete flight sequence for a warhead.

As long as the rocket motor 4 is in operation, the acceleration will keep the cylinder and motor together. When the motor stops, the aerodynamic forces will break these two apart along the lap joint 5. As shown in FIG. 4, this takes place at point 38, i.e. relatively soon after the motor has stopped. When the cylinder, i.e. the canister 2 with enclosed warhead 3, is separated by the aerodynamic forces from the burnt-out rocket motor 4, the parachute 12 opens and the stabilization phase is commenced. The different functional stages up to and including the point when the target seeker of the warhead has been activated and the seek-and-effect phase commenced may, for example, be controlled by a time function integrated in the target seeker 8 of the warhead which is activated when the cylinder is ejected out of the capsule.

Once the cylinder has passed the zenith 39 of the trajectory, a downward stabilization is commenced in the trajectory in order, thereafter, at point 40, to merge into a rotation and separation phase. The cylinder is then dependent on parachute 12 and its axis may not move more than a predetermined number of degrees from the vertical. The rotation and separation phase is introduced by the pyrocharge 33 being initiated by the previously mentioned time function and, in its turn, ignites the pyrocharge 16 which, in turn, ignites the propellant charge 21 via the non-return valve 17–20. Thereafter the non-return valves are closed and the combustion gases begin to flow out through the nozzle 27–30 and, because these are substantially tangentially directed thereupon accelerating the rotational speed of the cylinder. When the propellant charge 21 has essentially burned out, it brakes over the gas outlets 23–26 and the combustion gases begin to flow into the chamber 31, whereupon the sabot 32 forces the warhead 3 out of the canister 2 once the gas pressure has first entailed that safety devices in the form of pins or the like have been eliminated.

Figure 5:
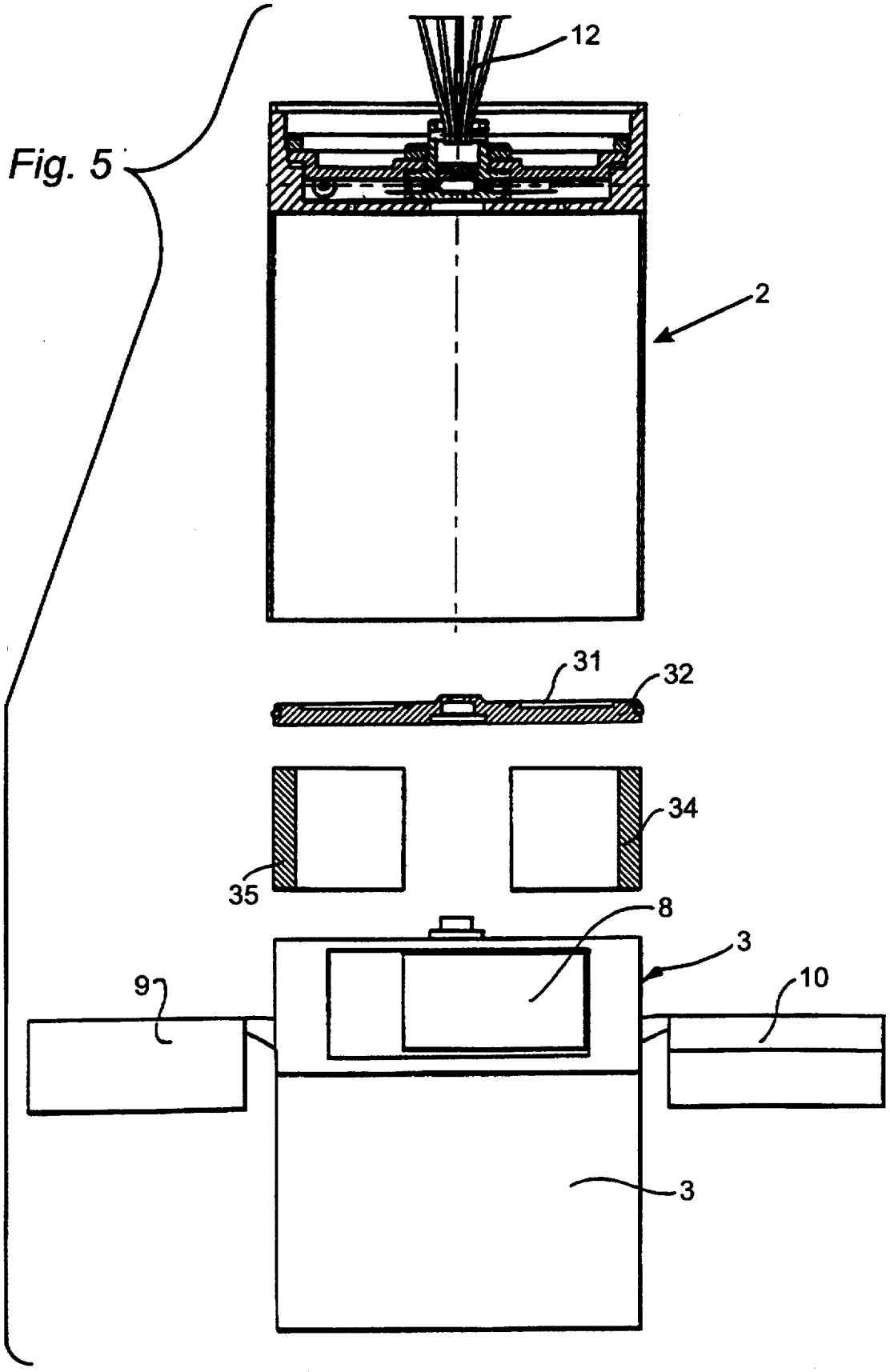
FIG. 5 is a longitudinal section through the canister and its parts immediately after the warhead has departed from the canister.

At this time, the function has reached that position which is illustrated in FIG. 5 where the warhead 3, the support halves 34 and 35, and the sabot 32 have entirely departed from the canister. As soon as the warhead 3 is free of the canister, the previously mentioned support surfaces 9 and 10 and the target seeker 8 are flipped out.

Figure 6:
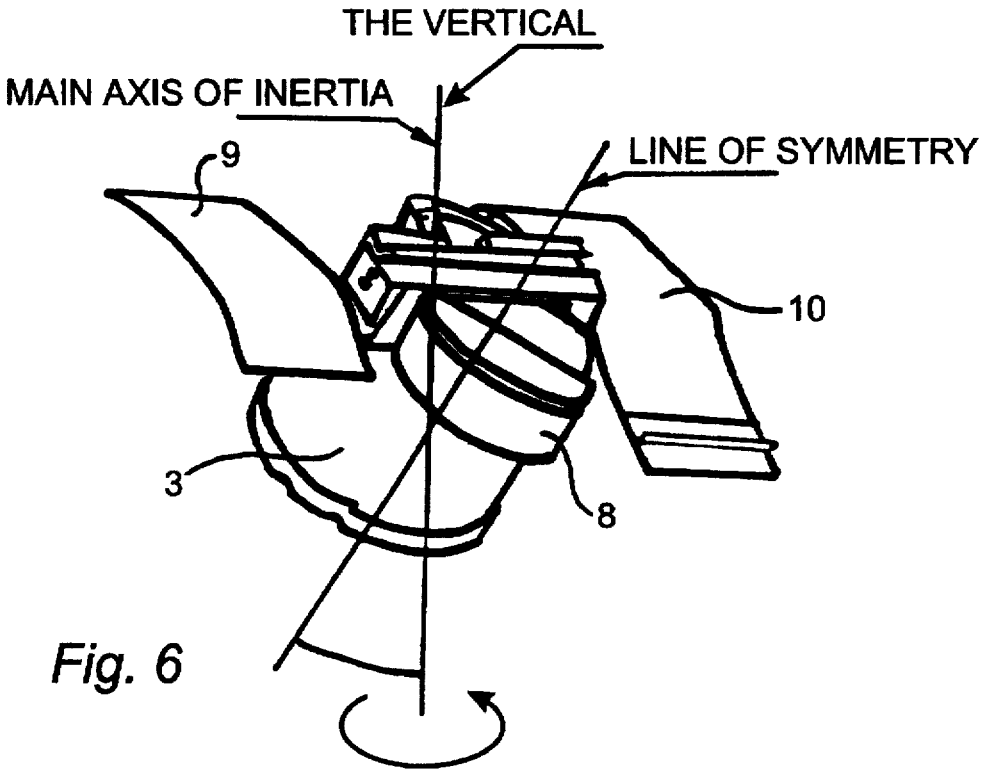
FIG. 6 is a basic diagram showing the flight position of the warhead during the seek and effect phase.

However, in the illustrated example the warhead rotates in the initial phase about the line of symmetry of the included effective charge, which, however, because the target seeker 8 has been flipped out beside it, does not coincide with the main axis of inertia of the warhead. After an additional fall distance, it will, however, have assumed rotation about the main axis of inertia which then, in its turn, begins to lie as close to the vertical as possible. With this direction as illustrated in FIG. 6, the target seeker and the line of symmetry of the effective charge will, by the rotation and simultaneous fall motion in the trajectory tangent, follow a helically continuous curve in towards the center which cover and is prepared to combat targets within a predetermined target area on ground level.

Figure 7:
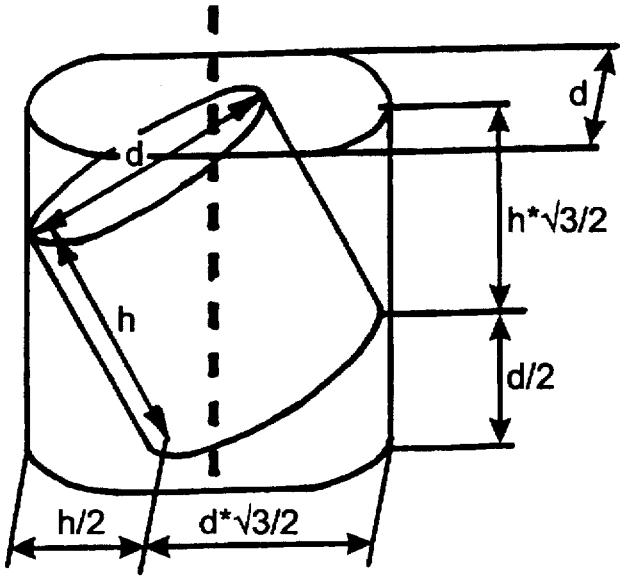
FIG. 7 shows an alternative arrangement for housing the warhead in the canister.

As is apparent from the foregoing, a certain time is required, i.e. the fall distance for the warhead 3 in accordance with the previously described example, to assume its stable position of rotation about the main axis of inertia, since it is initially rotated about the axis of symmetry of the effective charge. However, this time may be shortened and probably completely eliminated if the warhead is, already at the initial stage, spun about that axis which defines the position of the main axis of inertia when the target seeker and brake surfaces flipped out. This may either be effected in that the nozzles 27–30 are given asymmetric placement, or alternatively that the warhead is placed obliquely in the canister. This latter variant has been illustrated in FIG. 7. In this illustrated variant, a canister 41 of oval cross-section is employed.

The present invention should not be considered as restricted to that described above and shown in the drawings, many modifications being conceivable without departing from the spirit and scope of the appended claims.

What we claim and desire to secure by Letters Patent is:

1. A method of imparting in a continuous sequence, a predetermined rotational movement to a warhead releasably housed in a protective canister and ejected out in ballistic ejection trajectories from the canister, said method comprising the steps of:

spinning the canister to the desired rotational speed by flow of combustion gases through outlet nozzles discharging in the outer periphery of the canister;

supplying said outlet nozzles with combustion gases from a central combustion chamber in which a propellant powder charge is combusted; and leading the combustion gases from the combustion chamber, in the final phase of the propellant charge combustion, through gas outlets discharging in a direction towards the warhead initially covered by the propellant charge and exposed as a result of the combustion, for ejecting the warhead from the canister.

2. The method as claimed in claim 1, wherein the gas outlet nozzles of the canister are eccentric and are designed to together impart to the canister a rotational movement at a predetermined angle with the axis of the symmetry of the warhead coinciding with the main axis of inertia of the warhead after departure from the canister.

3. The method as claimed in claim 1, wherein the warhead housed in the canister is accelerated in rotational speed, given an axis of rotation which is obliquely inclined in relation to its own center axis and coincides with the main axis of inertia of the warhead departed from the canister and is disposed obliquely in the canister while ejection from the canister is effected in the central axial direction of the canister.

4. An apparatus for imparting in a continuous sequence to a warhead housed in a canister, a predetermined rotation and ejection of the warhead from the canister into a ballistic trajectory, said apparatus including:

an open end wall in the canister and at least one combustion chamber disposed at its other end;

a propellant charge disposed in the combustion chamber, the combustion chamber communicating with at least one outlet nozzle disposed at the periphery of the canister and angled in relation to the main axis of the canister such that combustion gases flowing therefrom on combustion of the powder impart to the canister rotational motion; and gas outlets discharging in a direction towards the warhead;

said gas outlets being covered by said propellant charge initially glued against that broad side of the combustion chamber facing towards the warhead and said gas outlets being exposed and leading the combustion gases from the combustion chamber, in the final phase of the propellant charge combustion, for ejecting the warhead from the canister.

5. The apparatus as claimed in claim 4, wherein the gas outlets located in the direction towards the warhead and initially covered by the propellant powder discharge into an expansion chamber behind a displaceable sabot on whose other side the warhead is placed.

6. The apparatus as claimed in claim 4, wherein the outlet nozzles are disposed eccentrically along the periphery of the canister.

7. The apparatus as claimed in claim 4, wherein the warhead is positioned in the canister such that its axis of symmetry forms an angle with the axis of symmetry of the canister.

* * * * *